US007011719B2

(12) United States Patent
Ostrovsky

(10) Patent No.: US 7,011,719 B2
(45) Date of Patent: Mar. 14, 2006

(54) TREATMENT FOR IMPROVED MAGNESIUM SURFACE CORROSION-RESISTANCE

(75) Inventor: Ilya Ostrovsky, Kibbutz Alonim (IL)

(73) Assignee: Alonim Holding Agricultural Cooperative Society Ltd., Kibbutz Alonim (IL)

( * ) Notice: Subject to any disclaimer, the term of this patent is extended or adjusted under 35 U.S.C. 154(b) by 0 days.

(21) Appl. No.: 10/873,217

(22) Filed: Jun. 23, 2004

(65) Prior Publication Data

US 2004/0234787 A1 Nov. 25, 2004

Related U.S. Application Data

(63) Continuation of application No. 10/179,241, filed on Jun. 26, 2002, now Pat. No. 6,777,094.

(60) Provisional application No. 60/301,147, filed on Jun. 28, 2001.

(51) Int. Cl.
*B05D 3/02* (2006.01)
*C23C 22/56* (2006.01)

(52) U.S. Cl. ..... 148/275; 427/387; 427/388.1

(58) Field of Classification Search ..... 148/275; 427/387, 388.1

See application file for complete search history.

(56) References Cited

U.S. PATENT DOCUMENTS

| | | | | |
|---|---|---|---|---|
| 2,035,380 A | | 3/1936 | Wilhem | |
| 3,457,124 A | | 7/1969 | Bohman | |
| 4,978,432 A | | 12/1990 | Schmeling et al. | |
| 5,264,113 A | | 11/1993 | Bartak et al. | |
| 5,292,549 A | | 3/1994 | Van Ooij et al. | |
| 5,393,353 A | | 2/1995 | Bishop | |
| 5,433,976 A | | 7/1995 | Van Ooij et al. | |
| 5,683,522 A | | 11/1997 | Joesten | |
| 5,750,197 A | | 5/1998 | Van Ooij et al. | |
| 5,759,629 A | | 6/1998 | Van Ooij et al. | |
| 6,106,901 A | * | 8/2000 | Song et al. | 427/387 |
| 6,126,997 A | | 10/2000 | Rivera et al. | |
| 6,162,547 A | * | 12/2000 | van Ooji et al. | 428/447 |
| 6,794,046 B1 | * | 9/2004 | Kurze et al. | 428/469 |

FOREIGN PATENT DOCUMENTS

| | | | |
|---|---|---|---|
| DE | WO 00/56950 | * | 9/2000 |
| EP | 0310103 | | 9/1988 |
| WO | WO99/02759 | | 1/1999 |

OTHER PUBLICATIONS

Smithells Metals Reference Book, Seventh Edition, Reed Educational and Professional Publishing Ltd., 1992, Chapter 22, pp. 1-22.*

"Evaluation of a nonionic surfactant as a phosphating additive" Sankara Narayanan et al ; Metal Finishing Nov. 1993 p. 65-68.

"l-Dodecyl Zanthate as a phosphating Additive: Aspects of Chemistry and Corrosion Protection" Nair et al, Plating and Surface Finishing, Jan. 1993.

* cited by examiner

*Primary Examiner*—Philip C. Tucker
(74) *Attorney, Agent, or Firm*—Mark M. Friedman

(57) ABSTRACT

A method, a composition and a method for making the composition for increasing the corrosion resistance of a magnesium or magnesium alloy surface is disclosed. The composition is a water/organic solution of one or more hydrolyzed silanes. By binding silane moieties to the magnesium surface, an anti-corrosion coating on a magnesium workpiece is produced. A complementary method, composition and method for preparing the composition for treating a metal surface to increase corrosion resistance is disclosed. The composition is an aqueous hydrogen fluoride solution with a non-ionic surfactant.

14 Claims, No Drawings

TREATMENT FOR IMPROVED MAGNESIUM SURFACE CORROSION-RESISTANCE

This application is a continuation of U.S. patent application Ser. No. 10/179,241, filed Jun. 26, 2002, now U.S. Pat. No. 6,777,094, which claims priority from U.S. Provisional Patent Application Ser. No. 60/301,147 filed Jun. 28, 2001.

FIELD OF THE INVENTION

The present invention is directed to the field of metal surface protection and more particularly, to a surface treatment that increases paintability and corrosion resistance of magnesium and magnesium alloy surfaces.

BACKGROUND OF THE INVENTION

The light weight and strength of magnesium and magnesium alloys makes products fashioned therefrom highly desirable for use in manufacturing critical components of, for example, high performance aircraft, land vehicles and electronic devices.

One of the most significant disadvantages of magnesium and magnesium alloys is corrosion. Exposure to the elements causes magnesium and magnesium alloy surfaces to corrode quickly, corrosion that is both unesthetic and reduces strength.

One strategy used to improve corrosion resistance of metal surfaces is painting. As the surface is protected from contact with corrosive agents, corrosion is prevented. However, many types of paint do not bind well to magnesium and magnesium alloy surfaces.

Methods based on chemical oxidation of an outer metal layer using chromate-solutions are known in the art as useful for treating magnesium and magnesium alloy surfaces to increase paint adhesion, see for example U.S. Pat. No. 2,035,380 or U.S. Pat. No. 3,457,124. However the low corrosion-resistance of treated surfaces and environmental unfriendliness of chromate solutions are definite disadvantages of these methods.

In PCT publication WO 99/02759 is described a method of providing a protective coating to a magnesium surface by polymerizing an electrostatically deposited resin comprising a variety of functional groups.

Several methods of metal surface treatment using silane solutions have been disclosed, see for example U.S. Pat. No. 5,292,549, U.S. Pat. No. 5,750,197, U.S. Pat. No. 5,759,629 and U.S. Pat. No. 6,106,901. Silane solutions are environmentally friendly and lend excellent corrosion resistance to treated metal surfaces. Silane residues from the solution bind to a treated metal surface preventing oxidation and forming a layer to which commonly-used polymers, such as paint, adhese, see U.S. Pat. No. 5,750,197. Although successfully applied to steel, aluminum, zinc and the respective alloys, magnesium and magnesium alloys have not been successfully treated with silane solutions.

U.S. Pat. No. 5,433,976 teaches alkaline solutions for the treatment of metal surfaces, the solutions including an inorganic silicate, inorganic aluminate, a cross-linking agent, and a silane. However, U.S. Pat. No. 5,433,976 does not teach the use of this solution for treating magnesium.

Another strategy used to improve corrosion resistance of metal surfaces is anodization, see for example U.S. Pat. No. 4,978,432, U.S. Pat. No. 4,978,432 and U.S. Pat. No. 5,264,113. In anodization, a metal surface is electrochemically oxidized to form a protective layer. Although anodization of magnesium and magnesium alloys affords protection against corrosion, adhesion of paint to anodized magnesium surfaces is not sufficient. Further, as discussed in U.S. Pat. No. 5,683,522, anodization often fails to form a protective layer on the entire surface of a complex workpiece.

It would be highly advantageous to have a method for treating magnesium or magnesium alloy surfaces so as to increase corrosion resistance beyond what is known in the art.

SUMMARY OF THE INVENTION

The present invention is of a method, a composition and a method for making the composition for increasing the corrosion resistance of a magnesium or magnesium alloy surface. The composition is a water/organic solution of one or more hydrolyzed silanes. By binding silane moieties to the magnesium surface, an anti-corrosion coating on a magnesium workpiece is produced.

According to the teachings of the present invention there is provided a composition useful for treating of a magnesium or magnesium alloy surface to increase polymer adhesion and corrosion resistance of the surface, the composition being a silane solution having a pH greater than about 4 and including at least one hydrolyzable silane in a water miscible solvent.

The solvent is one or more materials chosen from amongst water, alcohols, acetone, ethers and ethyl acetate.

The silanes are one or more silanes having at least one non hydrolyzable functiona; group chosen from amongst amino, vinyl, ureido, epoxy, mercapto, isocyanato, methacrylato, vinylbenzene and sulfane functional groups. Suitable silanes include, for example, vinyltrimethoxysilane, bis-triethoxysilylpropyl tetrasulfane, aminotrimethoxysilane, and ureidopropyltrimethoxysilane.

According to a feature of the present invention, the total concentration of hydrolyzable silanes in the silane solution is preferably between about 0.1% and about 30%, more preferably between about 0.5% and about 20% and even more preferably between about 1% and about 5%.

There is also provided according to the teachings of the present invention a method of treating a magnesium or magnesium alloy surface by preparing a silane treatment solution as described above and bring the solution in contact with the surface.

According to a feature of the present invention, preparation of the silane solution includes hydrolyzing the silanes in an aqueous solution having a pH of less than about 6, the pH achieved by adding acid, preferably acetic acid, to the hydrolyzing solution.

According to a feature of the present invention, preparation of the silane solution includes adding a base, preferably KOH, NaOH and $NH_4OH$, to the solution so that the final pH, subsequent to the addition of solvent, is at the desired value.

According to a feature of the present invention, when the treated surface is not anodized the pH of the silane solution is more than about 6, preferably more than about 8.

According to a feature of the present invention, one solution used to treat and anodized surface is where at least one of the hydrolyzable silanes in the silane solution is bis-triethoxysilylpropyl tetrasulfane and the solution preferably has a pH of between about 5 and about 8, more preferably of between about 6 and about 7. According to a feature of the present invention, when treating an anodized surface with a bis-triethoxysilylpropyl tetrasulfane solution, the total concentration of hydrolyzable silanes in the silane solution is preferably between about 0.1% and about 5%, more preferably between about 0.8% and about 2% and even more preferably between about 1% and about 2%.

Alternatively, according to a feature of the present invention, when the treated surface is anodized, the silane solution can include at least two different hydrolyzable silanes, the first being a nonfunctional bisilyl (e.g. 1,2 bis-(triethoxysilyl)ethane, 1,2-bis-(trimethoxysilyl)ethane, 1,6-bis-(trialkoxysilyl)hexanes and 1,2-bis-(triethoxysilyl)ethylene,) and the second a vinylsilane (e.g. vinyltrimethoxysilane ). By "nonfunctional bisilyl" is meant that excepting the function that connects the two silicon atoms together, the functional groups of the silane are all hydrolyzable.

According to a feature of the present invention, when treating an anodized surface with a silane solution including two hydrolyzable silanes the pH of the solution is preferably between about 4 and about 7, more preferably between about 4 and about 5.

According to a feature of the present invention, when treating an anodized surface with a silane solution including two hydrolyzable silanes the total concentration of hydrolyzable silanes in the silane solution is preferably between about 0.1% and about 30%, more preferably between about 0.5% and about 20% and even more preferably between about 1% and about 5%.

According to a feature of the present invention, when treating an anodized surface with a silane solution including two hydrolyzable silanes the molar ratio of hydrolyzable nonfunctional bisilyl to hydrolyzable vinylsilane is preferably between about 50:50 and about 10:90 and more preferably between about 20:80 and about 10:90.

According to a further feature of the present invention, prior to the contact of the silane solution with the surface, the surface is pretreated, for example with a hydrogen fluoride solution.

According to a still further feature of the present invention, subsequent to the contact of the silane solution with the surface, a polymer such as paint, adhesive or rubber is applied to the surface.

There is also provided according to the teachings of the present invention an anti-corrosion coating having a layer including magnesium atoms and silane moieties attached to at least some of said magnesium atoms in said layer by Si—O—Mg bonds. According to a feature of the present invention, the anti-corrosion coating also includes fluorine atoms attached to at least some of said magnesium atoms in the layer.

There is also provided according to the teachings of the present invention a method of binding silanes moieties to a magnesium or magnesium alloy surface by applying the silane solution as described above to the surface. Also provided according to the teachings of the present invention is a method of binding silanes moieties to an anodized magnesium or magnesium alloy surface by applying the silane solution as described above to the surface, by first anodizing the surface in a basic anodizing solution.

There is also provided according to the teachings of the present invention an article having at least one magnesium-containing surface and a corrosion resistant coating, the coating including a plurality of silane moieties, the silane moieties bound to the magnesium-containing surface by Si—O—Mg bonds. According to a feature of the present invention, at least about 1% of the plurality of silane moieties has at least one functional group from a group consisting of amino, vinyl, ureido, epoxy, mercapto, isocyanato, methacrylato, vinylbenzene and sulfane.

The present invention is also of a method, complementary to the method using silanes described hereinabove, a composition and method for making the composition for treating a metal surface to increase corrosion resistance. The composition is an aqueous hydrogen fluoride solution with a non-ionic surfactant.

According to the teachings of the present invention there is provided a composition (a treatment solution) useful for treating of a metal or metal alloy surface made up of hydrogen fluoride (HF) and a nonionic surfactant in water. According to a feature of the present invention the composition has an HF content of between about 5% and about 40%, by weight and a nonionic surfactant content of between about 20 ppm and about 1000 ppm. According to a further feature of the present invention the nonionic surfactant is a polyoxyalkylene ether, preferably a poloxyethylene ether, preferably chosen from a group consisting of polyoxyethylene oleyl ethers, polyoxyethylene cetyl ethers, polyoxyethylene stearyl ethers, polyoxyethylene dodecyl ethers, such as polyoxyethylene(10) oleyl ether.

There is also provided according to the teachings of the present invention a method of producing the treatment solution by combining the constituent components.

Also provided according to the teachings of the present invention is the treatment of a metal surface (corroded or not corroded) of a workpiece with the treatment solution by contacting the surface with the treatment solution.

Hereinfurther, the term "magnesium surface" will be understood to mean surfaces of magnesium metal or of magnesium-containing alloys. Magnesium alloys include but are not limited to alloys such as AM-50A, AM-60, AS-41, AZ-31, AZ-31B, AZ-61, AZ-63, AZ-80, AZ-81, AZ-91, AZ-91D, AZ-92, HK-31, HZ-32, EZ-33, M-1, QE-22, ZE-41,ZH-62, ZK-40ZK-51, ZK-60 and ZK-61.

DETAILED DESCRIPTION OF THE INVENTION

The present invention is of a method and solution useful in treating magnesium surfaces, anodized or not, to produce a corrosion-resistant layer which is also useful for preparing a magnesium surface for painting. The principles and use of the method and solutions of the present invention may be better understood with reference to the accompanying description.

The ability of hydrolyzable silanes (for example, those having one or more alkoxy or acyloxy substituents) to bind to metal surfaces is well know to one skilled in the art. The binding of silanes with a metal surface can generally be described as a three-step process. First, a hydrolyzable moiety is hydrolyzed. Second, the hydrolyzed silane migrates to the surface of the metal where it binds to a hydroxy group on the metal surface. Third and last, water is liberated and a covalent Si—O—Xx bond is formed, Xx being a metal atom.

Although there is some argument as to whether the silane layer is a monolayer or not, it is well known that the silane layer increases the corrosion resistance of the metal surface to which it is bound. It is also to known that when a metal surface is coated with a silane layer where the bound silane moieties have non-hydrolyzable organic functional groups, the layer increases adhesion of polymers such as paint, adhesives and other polymers. Apparently, the organic functional groups of the silane effectively interact with various types of polymer molecules.

Silane layers have been successfully used to make a protective coating for metal surfaces such as aluminum or zinc. Unfortunately, magnesium surfaces have not been successfully treated with silane solutions. The reasons arise from the virtually orthogonal requirements of the magnesium surface on the one hand and of the silanes on the other.

Magnesium easily corrodes in acid and even slightly basic environments: magnesium surfaces do not corrode at pH 12, but at lower pH corrosion does occur. Also, the concentration of the hydroxy moietys on a magnesium surface necessary for silane binding is related to pH. At basic pHs there is a high concentration of hydroxy moietys while at acidic pHs there is a dearth thereof.

In contrast, acidic environments are advantageous for binding of most silanes to metal. In general, the optimal pH for hydrolysis of most silanes is between 3 and 4. Further, in a basic environment, hydrolyzed silanes often condense to form dimers and higher polymers. The addition of alcohols to a solution containing hydrolysed silanes is known to reduce the rate of condenstion. Needless to say the rate of hydrolysis and rate of condensation is dependent on the nature of the silane itself. Some silanes quickly hydrolyze in neutral solutions while others hydrolyze so slowly that hydrolysis must be performed at a low pH for extended periods of time. Some silanes condense almost immediately in even slightly basic solutions while others remain stable for long periods of time even at high pH.

Before turning to details of the present invention, it should be appreciated that the present invention provides for a general method for using silane solutions for treating anodized and unanodized magnesium surfaces. The exact post-treatment properties of a treated surface and the exact conditions used to prepare a silane solution of the present invention are highly dependent on the nature of a specific silane used. In addition, the present invention provides five specific silane solutions for treating magnesium surfaces. As is discussed hereinbelow, the exact composition of a solution of the present invention as well as the method of preparation is quite flexible.

The five specific silane solutions of the present invention may all be used alone or may be used to treat a pre-treated surface. By pre-treated is meant, for example, treated by the aqueous hydrogen fluoride containing solution of the present invention. The aqueous hydrogen fluoride solution of the present invention is useful for conditioning a metal surface before treatment with a silane solution of the present invention or as a stand-alone corrosion inhibiting treatment.

First Solution: Treatment with Hydrogen Fluoride/Nonionic Surfactant Solution

The first solution of the present invention is an aqueous hydrogen fluoride (HF)/surfactant solution. A metal surface treated with a first solution of the present invention is seen to be remarkably corrosion resistant.

It is important to note that in the art the use of HF to treat magnesium surfaces, forming a corrosion-resistant Mg—F layer, is well known. Further, the use of long-chain hydrocarbon nonionic surfactants such as Brij® 97 on phosphate coatings of metals has been described (see Sankara Narayanan, T. S. N.; Subbaiyan, M. *Metal Finishing* 1993, 91, p.43 and Nair, U. B.; Subbaiyan, M. *Plating and Surface Finishing* 1993, 80, p.66).

Composition of the First Solution of the Present Invention

The first solution of the present invention is substantially an aqueous solution of hydogen fluoride (HF), where the HF content is preferably between 5% and 40%, even more preferably between 10% and 30% by volume to which is added a nonionic surfactant. The preferred nonionic surfactant is a polyoxyalkylene ether, preferably a polyoxyethylene ether, more preferably one of: polyoxyethylene oleyl ether, polyoxyethylene cetyl ether, polyoxyethylene stearyl ether, polyoxyethylene dodecyl ether, and most preferably polyoxyethylene(10) oleyl ether (sold commercially as Brij® 97). The amount of Brij® 97 added is preferably 20 to 1000 ppm, more preferably 40 to 500 ppm and even more preferably 100 to 400 ppm. When a surfactant other than Brij® 97 is added, an equivalent molar amount to that stated for Brij® 97 is preferred.

Use of the First Solution of the Present Invention

The first embodiment of the present invention involves the use of a first solution of the present invention to treat a metal or metal alloy surface The first solution is exceptionally useful for the treatment of bare surfaces and surfaces formed by a die casting process, especially magnesium surfaces. The first solution of the present invention can also be used to treat a corroded surface, simultaneously removing corrosion and modifying the surface so as to improve resistance to future corrosion. Further, it is also a preferred surface conditioning solution preceding treatment with a silane solution of the present invention.

The first embodiment of the method of the present invention involves applying a first solution of the present invention to the surface to be treated, preferably by dipping, preferably at a temperature between about 0° C. and about 40° C., more preferably between about 10° C. and about 30° C.

When the first solution of the present invention is applied by by dipping, the workpiece is allowed to remain exposed to the first solution for at least 10 minutes, preferably more than 20 minutes. After removal from the first solution, excess solution is washed away.

Silane Solutions for the Treatment of Magnesium Surfaces

As discussed hereinabove, the use of silane solutions to treat magnesium surfaces is difficult as conditions, methods of preparation and silanes must be found that bridge the opposing need of the magnesium surface for basic solutions with the need of silane solution to be acidic.

Most generally, the present invention is of the preparation and use of a water/organic solution with a pH greater than 6 having hydrolyzed silane moieties therein. When a silane solution of the present invention is formulated, the following factors must be considered.

To be suitable for use according to the present invention a silane must have at least one hydrolyzable functional group. In applications where it is desired to also adhese to polymer layers (e.g. to paint a treated surface) it is desirable that the silane have at least one non-hydrolyzable functional group. The organofunctional groups that are suitable include amino, vinyl, ureido, epoxy, mercapto, isocyanato, methacrylato, sulfane and vinylbenzene.

a. Concentration of Silane

In general the concentration of silane in a silane solution of the present invention is between about 0.1% and about 30% by volume. Generally speaking, high concentrations of silane are better as a denser coating is produced. However, higher concentrations of silane also lead to a much higher rate of silane condensation and the concomitantly higher operating costs due to wastage of the expensive silanes. Further, as many silanes are not very soluble in water or water/organic solutions, solutions having large proportions of silane are not homogenous. Although the exact amounts of silane to be used are dependent on many factors, it has been found that generally it is preferable to use a solution having between 0.5% and 20% silane by volume, and more preferable to use a solution having between 1% and 5% silane by volume.

b. Hydrolysis

As stated above, it is of the utmost importance that a silane be hydrolyzed for use in the present invention. Depending on the composition of the final solution, the nature of the individual silane and the time between preparation and first use it may or may not be necessary to perform a separate hydrolysis step. Although some silanes hydrolyze very quickly even in basic solutions and whereas in some cases the time between preparation and first use of a solution is very long, more often than not it is necessary to hydrolyze a silane in a separate step. Hydrolysis is retarded by significant concentrations of organic solvents and is accelerated by an acidic pH. Thus, a hydrolysis step is preferably performed in an acidic aqueous solution as a separate step.

If a silane needs to be hydrolyzed in a separate step in an acidic solution, any acid may be used, although organic acids are preferred. Most preferred is acetic acid as the salts of acetic acid are soluble in the solutions of the present invention.

A generally useful method of silane hydrolysis is performed by mixing 5 parts silane with between about 4 and 10 parts water and 1 part glacial acetic acid. The time required for hydrolysis is dependent on the silane. Typically, after 3 to 4 hours a sufficient proportion of silane has been hydrolyzed to allow preparation of a solution of the present invention.

c. Solvent

The ratio of water to organic in the solution is not per se determinative of the quality of the silane layer formed on the treated metal surface. Rather, the water/organic ratio defines the physical properties of the solution. In general, a high water-content is cheaper, environmentally friendly and allows for faster hydrolyzation of silanes. However, a high water-content promotes silane condensation, is less effective in solvating non-hydrolyzed silanes and it is difficult to dry a workpiece treated using an organic-less solution. In contrast, a high organic content retards both hydrolyzation and condensation, dries quickly and solvates silanes effectively.

Thus a desirable ratio of water to organic solvent is dependent on many factors. It is important to note, however, that the exact ratio is not of critical importance. In any case, hydrolysis of hydrolyzable silanes releases alcohols into the silane solution, whereas a hydrolysis step, a surface treatment step, and drag-in by treated workpieces (vide infra) releases water into the silane solution.

d. Alcohol and Other Organic Solvents

In general, any organic solvent that is miscible with water can be used in formulating a silane solution of the present invention. Although generally when methanol is used in formulating a silane solution of the present invention the best coating results are achieved, the difference is minor enough that the specific organic solvent chosen is not very important. Adequate coating results are achieved using many types of alcohol, especially lower aliphatic alcohols such as methanol, ethanol, propanol, isopropanol, butanol isomers and pentanol isomers. Adequate coating results are also achieved using non-alcohol organic solvents such as acetone, diethyl ether and ethyl acetate. Mixtures of individual organic solvents are also effective. Selection of a specific organic solvent or mixture of organic solvents is dependent on factors such as price, waste disposal, toxicity, safety, environment friendliness, rate of evaporation and solubility. However it is clear to one skilled in the art that due to solubility considerations coupled with property of an organic solvent to reduce the rate of silane condensation, the optimal choice of organic solvent may be dependent on the nature of the silane used.

e. Preparation

In general a first step of preparing a solution of the present invention is dependent on the silane used. If it is necessary that the silane be hydrolyzed in a separate step, this is done.

If no separate hydrolysis step is necessary the silane is directly diluted in the water/organic solution. Otherwise, after a sufficient time, the silane hydrolysis solution is diluted in the water/organic solution.

In some cases the diluted solution is not homogenous and cloudy, indicative that unhydrolyzed silane is not completely dissolved. Although a not homogenous solution can be used to treat a surface, adjusting the pH (see immediately hereinbelow) or addition of organic solvent may solublize the remaining not hydrolyzed silane. It is important to note that many silanes hydrolyze slowly in a solution of the present invention so that often, during use, remaining undissolved silane is eventually hydrolyzed even without further intervention.

f. Adjusting the pH

Before use, the pH of the silane solution of the present invention must be adjusted to a desired value. According to the present invention, in order to treat an unanodized magnesium surface, a solution of the present invention must have a pH above about 6, and more preferably above about 8. If the pH is not in the desired range, the pH is preferably adjusted using an inorganic base and most preferably KOH, NaOH or $NH_4OH$.

According to the present invention, for treating an anodized metal surface, the pH of a silane solution must be greater than about 4, vide infra.

g. Buffers

Both for hydrolysis and for the silane solution itself, it is often advantageous to use a pH buffer. The use of a pH buffer may be useful for industrial process control, especially under good manufacturing practice (GMP) discipline or to ensure the stability of a specific silane. The preferred buffer systems are those which do not produce precipitate in the solutions used. Most preferred are buffer systems using ammonium acetate or sodium acetate.

h. Surfactants

In many cases it may be advantageous to add nonionic surfactants to a silane solution of the present invention to increase corrosion resistance of a treated surface. The preferred surfactants as well as the amounts added are as listed hereinabove for the first solution of the present invention.

i. Pretreatment

Before treating a metal surface with a solution of the present invention, it is advantageous to pre-treat the surface to increase corrosion resistance even beyond the remarkable corrosion resistance gained from using the silane solutions of the present invention alone. Pre-treatment can be performed, for example, by treating with HF as is known in the art or with a fluoride/phosphate solution as described, for example, in U.S. Pat. No. 5,683,522. Best results, however, are obtained by pre-treatment using the first solution of the present invention.

i. Application

Treatment of a metal surface using a silane solution of the present invention is preferably done by dipping, spraying, wiping or brushing.

When the silane solution of the present invention is applied to the magnesium surface by dipping, the workpiece is preferably exposed to the silane solution for at least 1 minute, although even a few seconds is often enough. After removal from the solution, the workpiece is drip, blow or air-dried.

When a silane solution of the present invention is applied to a magnesium surface by spraying, at least about 0.1 ml solution/$cm^2$ of metal surface to be treated is sprayed. Thereafter, the workpiece is drip, blow or air-dried.

The temperature of the solution during application is not critical so there is no need to heat the solution. Since heating requires an additional energy expenditure and may lead to an increased rate of silane condensation, application preferably occurs at ambient temperatures that is preferably at a temperature between about 0° C. and about 40° C., more preferably between about 10° C. and about 25° C.

j. Curing

As is clear to one skilled in the art, a silane layer cured at elevated temperatures (e.g. preferably above about 110° C.) converts to a siloxane layer. It has been found that all things being equal, a surface treated with a silane solution of the present invention and subsequently cured has a greater corrosion resistance but lowered paint adhesion than a treated but not cured surface.

Curing can be performed for virtually any length of time, from half a minute up to even hours.

k. Storage of a Silane Solution

As is clear to one skilled in the art, in an industrial setting where a silane solution of the present invention is applied by dipping the workpiece into a bath of the solution, the solution is rarely made anew for every workpiece. Rather a bath is filled with a prepared solution and the contents therein are periodically replenished. Thus, when formulating a silane solution of the present invention for such an application this must be kept in mind. In general, for long-term storage the silane concentration and pH of a solution of the present invention must be chosen so that silane condensation is minimized. The primary "contaminant" that may enter the bath is water dragged-in by workpieces. Although water drag-in does not change the pH, it may increase the proportion of water to a point that silane condensation occurs quickly.

Additionally, the slow rate of silane hydrolysis at the pH of a silane solution of the present invention must be taken into account. Even if a specific silane hydrolyzes only slowly, the rate may be sufficient so that no special action needs be taken. Pure silane is added (taking care that the final silane concentration in the bath does not exceed the desired) and slowly hydrolyzes. When a silane is used that cannot hydrolyze efficiently at the pH of the silane solution, the added silane is first hydrolyzed in a separate step and then added to the silane solution.

It is clear to one skilled in the art that in applications where a solution of the present invention is to be stored or kept for an extended period of time, it is often advantageous to use a pH buffer, as described hereinabove. Further, it is also clear to one skilled in the art that the composition of a silane solution of the present invention is not sharply defined but rather can change with time.

Specific Silane Solutions of the Present Invention

Second Solution: Bis-triethoxysilylpropyl Tetrasulfane Solution

The second solution of the present invention is a bis-triethoxysilylpropyl tetrasulfane solution. A bis-triethoxysilylpropyl tetrasulfane solution of the present invention is exceptionally useful for the treatment of bare magnesium surfaces or a magnesium surface pretreated using the first solution of the present invention. The silane layer formed allows excellent powder-paint or E-coating adhesion but also acts as an excellent corrosion resistant and water repellant protective coating. The water repellance is so great that when liquid paint is applied, the paint beads on a treated surface. A bis-triethoxysilylpropyl tetrasulfane solution of the present invention is also exceptionally useful for the treatment of anodized surfaces, see below.

Due to the slow rate of hydrolysis, bis-triethoxysilylpropyl tetrasulfane is preferably hydrolyzed in a separate step before formulation of the silane solution of the present invention itself. Hydrolysis is preferably performed as described hereinabove, for between 3 and 12 hours. Even after such a long hydrolysis time, the resulting solution is cloudy, indicative that a significant proportion of the bis-triethoxysilylpropyl tetrasulfane is neither hydrolyzed nor dissolved.

After hydrolysis, the bis-triethoxysilylpropyl tetrasulfane solution of the present invention is ideally made-up with a water/organic solution having between about 70% and about 100% organic solvent, more preferably between about 90% and about 100% organic solvent. It has been observed that even in solutions with only moderate water content, at useful pHs the bis-triethoxysilylpropyl tetrasulfane quickly undergoes condensation.

The second solution of the present invention preferably has a pH above about 6, more preferably between about 6 and about 10, and most preferably between about 7 and about 8.

Third Solution: Vinyl Silane Solution

The third solution of the present invention is a vinyl silane solution. Of the four substituents of the silicon atom in the silane, at least one is a hydrolyzable moiety (preferably an alkoxy moiety such as methoxy or ethoxy or an aryloxy or acyloxy moiety) and at least one is a vinyl moiety. For example, vinyltrimethoxysilane is an ideal silane for use in formulating the third solution of the present invention.

As described hereinabove the purpose of the hydrolyzable moiety is to allow silane binding to the metal surface whereas the purpose of the vinyl moiety is to interact with a following paint layer. Thus, a third vinyl silane solution of the present invention is exceptionally useful for the treatment of bare surfaces or a surface treated using the first solution of the present invention. The silane layer formed allows excellent liquid-paint (especially epoxy paint systems, acrylic paint systems and polyurethane paint systems) adhesion but also acts as a stand-alone corrosion resistant coating.

Due to the slow rate of hydrolysis in high pH, vinyl silanes such as vinyltrimethoxysilane are preferably hydrolyzed in a separate step before formulation of the silane solution of the present invention itself. Hydrolysis is preferably performed as described hereinabove.

After hydrolysis, the vinyl silane solution of the present invention is ideally made up with a water/organic solution having between about 25% and about 75% organic solvent, more preferably between about 40% and about 60% organic solvent.

The vinyl silane solution of the present invention preferably has a pH above about 6, more preferably between about 7 and about 10, and most preferably between about 6 and about 7.

Fourth Solution: Amino Silane Solution

The fourth solution of the present invention is an amino silane solution. Of the four substituents of the silicon atom in the silane, at least one is a hydrolyzable moiety (preferably an alkoxy moiety such as methoxy or ethoxy or an aryloxy or acyloxy moiety) and at least one is an amino moiety. For example, aminotrimethoxysilane is an ideal silane for use in formulating the fourth solution of the present invention.

As described hereinabove the purpose of the hydrolyzable moiety is to allow silane binding to the metal surface whereas the purpose of the amino moiety is to interact with a subsequent paint layer. Thus, a fourth amino silane solution of the present invention is useful for the treatment of bare (recently cleaned) surfaces or a surface treated using the first solution of the present invention. The amino silane layer formed allows good liquid-paint (especially epoxy paint systems, acrylic paint systems and polyurethane paint systems) adhesion but also acts as a corrosion resistant coating. That said, it has been found that the corrosion resistance of a surface treated with a fourth solution of the present invention is inferior to that afforded by other solutions of the present invention. However, the ease of preparation (see immediately hereinbelow) of the fourth solution of the present invention is such that the fourth solution of the present invention can be used in an effective fashion to temporarily protect magnesium workpieces in the stead of oils or greases.

Amino silanes are resistant to condensation and have a naturally basic pH. Thus when preparing a fourth solution of the present invention it is usually possible to omit the step of addition of base. Further, amino silanes hydrolyze very quickly even in basic solutions. It is therefore not necessary to perform a separate hydrolysis step when using amino silanes according to the present invention. Hydrolysis is in fact so quick that, for example, a 5% solution of aminotrimethoxysilane in water can be made and directly applied (for example by spraying) to a magnesium surface of a workpiece.

Fifth Solution: Ureido Silane Solution

The fifth solution of the present invention is a ureido silane solution. Of the four substituents of the silicon atom in the silane, at least one is a hydrolyzable moiety (preferably an alkoxy moiety such as methoxy or ethoxy or an aryloxy or acyloxy) and at least one is an ureido moiety. For example, ureidopropyltrimethoxysilane is an ideal silane for preparing the fifth solution of the present invention.

As described hereinabove the purpose of the hydrolyzable moiety is to allow silane binding to the metal surface whereas the purpose of the ureido moiety is to interact with a subsequent paint layer. Thus, a fifth ureido silane solution of the present invention is exceptionally useful for the treatment of bare surfaces or a surface treated using the first solution of the present invention. The silane layer formed allows excellent liquid-paint (especially epoxy paint systems, acrylic paint systems and polyurethane paint systems) adhesion but also acts as a stand alone corrosion resistant coating.

Ureido silanes are resistant to condensation and have a naturally basic pH. Thus it is usually possible to omit the step of addition of base when formulating a ureido silane solution of the present invention. Further, ureido silanes hydrolyse very quickly even in basic solutions. It is therefore not necessary to perform a separate hydrolysis step when using ureido silanes according to the present invention. That said, it is often preferable to first add a ureido silane to an equal volume of water and, after between 15 and 30 minutes, to dilute the thus-hydrolyzed silane with a water/organic solvent.

The ureido silane solution of the present invention preferably has a pH above about 6, more preferably above about 8 and most preferably above about 10.

Treatment of Anodized Magnesium Surfaces

Unlike unanodized magnesium surfaces, anodized magensium surfaces have a sufficient hydroxy concentration for effective silane binding even at an acidic pH. Further, anodized surfaces are acid-resistant so can be treated at the lower pHs which are more suitable for silane solutions, It is important to note that when a silane solution of the present invention is used to treat an anodized surface, the anodization must be performed in a basic and not in acidic solution. It has been found that silanes do not effectively bind to surfaces anodized under acidic conditions. Examples of anodizing processes performed in a basic solution are described in U.S. Pat. No. 4,978,432 and U.S. Pat. No. 5,264,113.

Second Solution: Bis-triethoxysilylpropyl Tetrasulfane Solution

As stated hereinabove, the second solution of the present invention, a bis-triethoxysilylpropyl tetrasulfane solution, is exceptionally useful in treating anodized surfaces. The silane layer formed allows excellent powder-paint or E-coating adhesion but also acts alones as an excellent corrosion resistant and water-repellant protective coating.

When the second solution is used to treat an anodized surface, the pH is preferably close to neutral, in the range of from about 5 to about 8 and more preferably from about 6 to about 7.

When used to treat an anodized surface, the amount of bis-triethoxysilylpropyl tetrasulfane used is preferably from about 0.1% to about 5% of the solution, more preferably from about 0.8% to about 2%, and most preferably from about 1% to about 2%.

Sixth Solution: Vinyl Silane with a Nonfunctional Bisilyl Solution

The sixth solution of the present invention is composed of a mixture of two silanes, a vinyl silane and a nonfunctional bisilyl compound.

The nonfunctional bisilyl compound used in formulating the sixth solution of the present invention is preferably a nonfunctional bisilyl alkyl compound such as 1,2 bis-(triethoxysilyl)ethane. Other preferred nonfunctional bisilyl compounds include 1,2-bis-(trimethoxysilyl)ethane, 1,6-bis-(trialkoxysilyl)hexanes and 1,2-bis-(triethoxysilyl)ethylene.

Nonfunctional bisilyl compounds tend to condense very quickly at a basic pH so are unsuitable for use in sealing unanodized magnesium surfaces as described hereinabove. However, it has been found that nonfunctional bisilyl compounds lend remarkable corrosion resistance to anodized surfaces when used in accordance with the teachings of the present invention.

The lack of a non-hydrolyzable moiety on these nonfunctional bisilyls prevents painting of an anodized surface after treatment exclusively with a nonfunctional bisilyl. To overcome this disadvantage, a vinyl silane is also used when formulating the sixth solution of the present invention. As described above for the third solution of the present invention, of the four substituents of the silicon atom in the vinyl silane, at least one is a hydrolyzable moiety (preferably an alkoxy moiety such as methoxy or ethoxy or an aryloxy or acyloxy moiety) and at least one is a vinyl moiety. For example, vinyltrimethoxysilane is an ideal silane for use in formulating the sixth solution of the present invention. As described hereinabove the purpose of the hydrolyzable moiety is to allow silane binding to the metal surface whereas the purpose of the vinyl moiety is to interact with a subsequent paint layer.

A sixth silane solution of the present invention is exceptionally useful for the treatment of anodized surfaces or an anodized surface treated using the first solution of the present invention. The silane layer formed allows excellent liquid-paint (especially epoxy paint systems, acrylic paint systems and polyurethane paint systems) adhesion, an excellent E-coating pretreatment and also acts as a stand-alone sealing and protective coating for anodized surfaces.

When formulating a sixth solution of the present invention, the total amount of silane is preferably between about 0.1% and about 30%, more preferably between about 0.5% and about 20%, and even more preferably between about 1% and about 5% silane by volume. Any ratio of silanes can be used, but preferably the molar ratio of nonfunctional bisilyl to vinyl silyl is between about 50:50 to about 10:90, more preferably the ratio is between about 20:80 and about 10:90. It is important to note that the ratios stated herein refer to the ratio of silanes added to the solution, and not to the ratio of hydrolyzed silanes in the solution when ready for use.

Hydrolysis is preferably performed as described hereinabove, wherein first the two silanes are combined and thereafter hydrolyzed in an aqueous acid solution After hydrolysis, the sixth silane solution of the present invention is ideally made up with a water/organic solution having between about 25% and about 75% organic solvent, more preferably between about 40% and about 60% organic solvent.

The sixth solution of the present invention preferably has a pH between about 4 and about 7, and more preferably between about 4 and about 5.

SPECIFIC SYNTHETIC EXAMPLES

First Solution of the Present Invention

70% HF was diluted with distilled water to make a 20% HF solution. To the 20% HF solution 300 ppm Brij® 97 was added. The solution was labeled solution A.

Corrosion Resistance After Treatment with a First Solution of the Invention

Two solid magnesium diecast blocks were cleaned in a strong alkaline cleaning solution, rinsed in excess water. One block was dipped for 25 minutes in a 20% HF solution while the other block was dipped for 25 minutes in a bath of solution A. The two blocks were allowed to air dry.

The blocks were exposed to 5% salt fog in accordance with requirements of the ASTM-117. After 8 hours, corrosion was observed on the block exposed to solution A, compared to only six hours for the block exposed to the HF solution.

Corrosion Resistance of a Corroded Surface After Treatment with a First Solution of the Invention A solid magnesium diecast corroded block was dipped in a bath containing solution A for 25 minutes. The block was allowed to air dry.

The corroded block was exposed to 5% salt fog in accordance with requirements of the ASTM-117. After 8 hours, the diecast block retained its original, albeit corroded, appearance.

Second Solution of the Present Invention

Corrosion Resistance After Treatment with a Second Solution of the Invention 5 ml of glacial acetic acid were added to 50 ml of water. To this acid solution was added 50 ml bis-triethoxysilylpropyl tetrasulfane. The silane/acetic acid solution was stirred for three hours to allow silane hydrolyzation. After the three hours, the silane/acetic acid solution was added to a 4:1 mixture of ethanol and isopropanol to get one liter of solution B1, a second solution of the present invention. The pH of solution B1 was adjusted to approximately 7.5 by addition of a 1 M NaOH solution.

A solid magnesium diecast block and a Thixomold® block of AZ91 alloy were cleaned in a strong alkaline cleaning solution, rinsed in excess water and dipped in a bath containing solution B1 for 2 minutes. The two blocks were allowed to air dry.

The electrical resistance of the two blocks was tested in accordance with Fed. Std. No. 141. The electrical resistance of both blocks was 0.004 Ohm/inch$^2$.

The diecast block was exposed to 5% salt fog in accordance with requirements of the ASTM-117. After 48 hours, the diecast block retained its original appearance. A control block of a chromate conversion treated magnesium block was heavily corroded under the same conditions.

The Thixomold® block was immersed in a 5% solution of sodium chloride. After 24 hours only minimal pitting was observed. A control block of a chromate conversion treated Thixomold® block was heavily corroded under the same conditions.

Corrosion Resistance of Anodized Part After Treatment with a Second Solution of the Invention Two diecast blocks of Az91 alloy were anodized with a 12 micron layer using the basic pH anodizing procedures described in MIL-M-45202 Type II. One of the two blocks was immersed in a bath containing solution B1 for 2 minutes. The block was allowed to air dry. Both blocks were exposed to 5% salt fog in accordance with requirements of the ASTM-117. The first corrosion pits were observed after 300 hours in the untreated block. The first corrosion pits were observed after 500 hours in the block treated with solution B1.

Powder Paint Adhesion After Treatment with a Second Solution of the Invention 2.5 ml of glacial acetic acid were added to 25 ml of water. To the acid solution was added 25 ml bis-triethoxysilylpropyl tetrasulfane. The silane/acetic acid solution was stirred for three hours to allow silane hydrolyzation. After the three hours, the silane/acetic acid solution was added to a 4:1 mixture of ethanol and isopropanol to get one liter of solution B2, a second solution of the present invention. The pH of solution B2 was adjusted to approximately 7.5 by addition of a 1 M NaOH solution.

A diecast block of Az91 alloy were cleaned in a strong alkaline cleaning solution, rinsed in excess water and dipped in a bath containing solution B2 for 2 minutes. The block was allowed to air dry. After drying the block was painted using an epoxy-phenolic powder coating system.

The adhesion of the paint to the block treated with solution B2 was tested in accordance with requirements of DIN ISO 2409. The part passed the test. A control block was painted in an identical fashion after only a cleaning, rinsing and drying step. The paint peeled from the control block under the test conditions.

Powder Paint Resistance to Corrosion After Treatment with a Second Solution of the Invention Three diecast blocks of AZ91 alloy were cleaned in a strong alkaline cleaning solution and rinsed in excess water. The second and third blocks were both dipped in a bath containing solution B2 for 2 minutes. The blocks were allowed to air dry. After drying, the first (untreated) and third (treated) block were painted using an epoxy-phenolic powder coating system.

Adhesion of the paint to the first (untreated) block was so poor that the block was not tested further.

The second and third diecast blocks were exposed to 5% salt fog in accordance with requirements of the ASTM-117. After 48 hours, the first signs of corrosion were observed on the second (unpainted) block The third diecast block that was treated and painted showed no evidence of corrosion, even after 1000 hours of exposure to the salt fog.

First, Third, Fourth and Fifth Solutions of the Present Invention 2.5 ml of glacial acetic acid were added to 25 ml of vinyltrimethoxysilane. To the acid/silane solution was added 25 ml water. The silane/acetic acid solution was stirred for three hours to allow silane hydrolyzation. After the three hours, the silane/acetic acid solution was added to a 4:1:5 mixture of ethanol/isopropanol/water to get one liter of solution C1, a third solution of the present invention. The pH of solution C1 was adjusted to approximately 6.5 by addition of a 1 M sodium hydroxide solution.

In a similar fashion a fourth solution of the present invention C2 was made having 25 ml of aminotrimethoxysilane. Since aminotrimethoxysilane hydrolyzes quickly, it was diluted, without additional acid, in 975 ml of a 4:1:5 mixture of ethanol/isopropanol/water.

In a similar fashion a fifth solution of the present invention C3 was made having 25 ml of ureidotrimethoxysilane. Since ureidotrimethoxysilane hydrolyzes quickly, it was diluted, without additional acid, in 975 ml of a 4:1:5 mixture of ethanol/isopropanol/water.

Corrosion Resistance After Treatment with Third, Fourth and Fifth Solutions of the Invention Three diecast blocks made of magnesium AM-60 were cleaned in a strong alkaline cleaning solution and rinsed with water.

The first block was immersed in solution C1 for 2 minutes and blow-dried. The second block was immersed in solution C2 for 2 minutes and blow-dried. The third block was immersed in solution C3 for 2 minutes and blow-dried.

The three blocks were exposed to 5% salt fog in accordance with requirements of the ASTM-117. More than 1% corrosion appeared on the first block after 24 hours. At least 1% corrosion appeared on the second block after 8 hours. At least 1% corrosion appeared on the third block after 16 hours.

Corrosion Resistance After Treatment with a First and Third Solution of the Invention Three diecast blocks made of magnesium AM-60 were cleaned in a strong alkaline cleaning solution and rinsed with water.

A first block was dried.

The second and third block were immersed in solution A for 25 minutes and subsequently rinsed with water.

The second block was dried.

The third block was immersed in solution C1 for 2 minutes and thereafter cured in an oven at a temperature of 120° C.

The three blocks were exposed to 5% salt fog in accordance with requirements of the ASTM-117. More than 1% corrosion appeared on the first block after 1 hour. At least 1% corrosion appeared on the second block after 8 hours. At least 1% corrosion appeared on the third block after 24 hours.

Wet Paint Adhesion After Treatment with a Third Solution of the Invention

A diecast block of AM-60 alloy were cleaned in a strong alkaline cleaning solution, rinsed in excess water and dipped in a bath containing solution C1 for 2 minutes. The block was allowed to air dry. After drying the block was painted using a polyurethane paint system.

The adhesion of the paint to the block treated with solution C1 was tested in accordance with requirements of DIN ISO 2409. The block passed the test.

Surface Residue After Treatment with a First and Third Solution of the Invention A die-cast block of AZ-91 alloy was treated successively with solution A and solution C. After treatment with solution A, spectrophotoscopic analysis of the surface showed the following surface atomic concentrations (in percent):

| S | C | Ca | N | O | F | Na | Mg | Al | Si |
|---|---|---|---|---|---|---|---|---|---|
| 1.4 | 31.1 | 4.1 | 1.3 | 18.9 | 12.2 | 1.4 | 27 | 2.7 | — |

After treatment with solution C, spectrophotoscopic analysis of the surface showed the following surface atomic concentrations (in percent):

| S | C | Ca | N | O | F | Na | Mg | Al | Si |
|---|---|---|---|---|---|---|---|---|---|
| — | 26.0 | — | — | 44.1 | 2.6 | — | 3.9 | 0.1 | 23.4 |

From the evidence it is seen that solution A produces a fluorine-rich layer on the surface of the AZ-91 block and that solution C left a silane-rich layer on the surface on top of the fluorine-rich layer.

After 17 minutes of sputter cleaning (at 10 A/min), the atomic concentration of Si at the surface decreased from 19.64% to 19.31%. Under the same conditions the atomic concentration of magnesium increased from 1.71 to 15.0% and of fluorine from 4.86% to 16.99%. Note that the differences in starting concentrations found in the sputter cleaning and the spectrophotoscopic analyses are attributable to different cleaning procedures used in these two different analyses.

Thus successive treatment of a magnesium block using a first solution of the present invention and a silane-containing solution of the present invention produces a magnesium: magnesium fluoride:silane "sandwich".

Sixth Solution of the Present Invention

Corrosion Resistance After Treatment with a Sixth Solution of the Invention 5 ml of glacial acetic acid were added to a mixture of 40 ml vinyltrimethoxysilane and 10 ml of bis-triethoxysilyl ethane. To the silane/acid solution was added 50 ml water. The silane/acetic acid/water solution was stirred for six hours to allow silane hydrolyzation. After the six hours, the silane/acetic acid solution was added to a 4:1:5 mixture of ethanol/isopropanol/water to get one liter of solution D, a sixth solution of the present invention. The pH of solution D was adjusted to approximately 4.5 by addition of a 1 M NaOH solution.

Two diecast blocks of magnesium alloy AM-60 alloy were anodized with a 12-micron layer using the basic pH anodizing procedures known in the art as ANOMAG®. One of the two blocks was immersed in a bath containing solution D for 2 minutes. The blocks were allowed to air dry.

Both blocks were exposed to 5% salt fog in accordance with requirements of the ASTM-117. The first corrosion pits were observed after 48 hours in the untreated block. The first corrosion pits were observed after 260 hours in the block treated with solution D.

Wet Paint Adhesion After Treatment with a Sixth Solution of the Invention

A diecast blocks of magnesium alloy AM-60 alloy was anodized with a 12 micron layer using the anodizing procedure described in U.S. provisional patent No. 60/301,147 and in a copending patent application by the same inventor. The block was immersed in a bath containing solution D for 2 minutes. The block was allowed to air dry. After drying the block was painted using a polyurethane paint system.

The adhesion of the paint to the block treated with solution D was tested in accordance with requirements of DIN ISO 2409. The block passed the test. A control block was painted in an identical fashion after only a cleaning, rinsing and drying step. The paint peeled from the control block under the test conditions.

The invention claimed is:

1. A method of treating a workpiece, the method comprising the steps of:

a) providing a surface of the workpiece, said surface chosen from the group consisting of magnesium surfaces and magnesium alloy surfaces;

b) contacting said surface with a strong alkaline cleaning solution and then rinsing the cleaned surface of the workpiece with water;

c) providing a treatment solution having a pH greater than about 8 and containing a non-water water miscible solvent and at least one hydrolyzable silane that is at least partially hydrolyzed in water; and d) contacting said surface, successively to step b), with said treatment solution.

2. The method of claim 1 wherein said non-water water miscible solvent includes at least one of the substances chosen from a group consisting of alcohols, acetone, ethers and ethyl acetate.

3. The method of claim 1 wherein at least one of said at least one hydrolyzable silane has at least one functional group from a group consisting of amino, vinyl, ureido, epoxy, mercapto, isocyanato, methacrylato, vinylbenzene and sulfane.

4. The method of claim 1 wherein at least one of said at least one hydrolyzable silane is chosen from a group consisting of bis-triethoxysilylpropyl tetrasulfane, vinyltrimethoxysilane, aminotrimethoxysilane, and ureidopropyltrimethoxysilane.

5. The method of claim 1 wherein said treatment solution has a pH greater than about 10.

6. The method of claim 1 wherein said preparing a treatment solution comprises:

i. preparing a hydrolyzing solution by mixing a hydrolyzable silane in an aqueous solution; and ii. subsequent to said mixing ensuring that said hydrolyzing solution has a pH of less than about 6.

7. The method of claim 6 wherein said ensuring that said hydrolyzing solution has a pH of less than about 6 comprises adding an amount of acid to said hydrolyzing solution.

8. The method of claim 7 wherein said acid is acetic acid.

9. The method of claim 1 wherein said preparing a treatment solution includes:

i. mixing an amount of said at least one hydrolyzable silane with said water; and ii. ensuring that said treatment solution has a desired pH.

10. The method of claim 9 wherein said ensuring that said treatment solution has a desired pH comprises adding an amount of a base to said treatment solution.

11. The method of claim 10 wherein said base is chosen from a group consisting of KOH, NaOH and $NH_4OH$.

12. The method of claim 9 wherein said amount of said at least one hydrolyzable silane is chosen so that a total hydrolyzable silane content of said treatment solution is between about 0.1% and about 30% by volume, preferable between about 0.5% and about 20% by volume, more preferred between about 1% and about 5% by volume.

13. A method of treating a workpiece, the method comprising the steps of:

a) providing a surface of the workpiece, said surface chosen from the group consisting of magnesium surfaces and magnesium alloy surfaces;

b) contacting said surface with a strong alkaline cleaning solution to form a modified surface having a plurality of Mg—O—H bonds, and then rinsing the cleaned surface of the workpiece with water, c) providing a treatment solution having a pH greater than about 8 and containing a non-water water miscible solvent and at least one hydrolyzable silane that is at least partially hydrolyzed in water; and d) contacting said modified surface with said treatment solution, so as to convert said plurality of Mg—O—H bonds to a plurality of Mg—O—Si bonds.

14. The method of claim 13 wherein said pH is greater than about 10.

* * * * *